US008435060B2

(12) United States Patent
Pickard et al.

(10) Patent No.: US 8,435,060 B2
(45) Date of Patent: May 7, 2013

(54) FIXTURES, APPARATUSES, AND RELATED METHODS FOR PROVIDING LOAD BEARING CONNECTIONS FOR LIGHTING DEVICES

(75) Inventors: Paul K. Pickard, Morrisville, NC (US); Gary D. Trott, Morrisville, NC (US); James Michael Lay, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 12/983,638

(22) Filed: Jan. 3, 2011

(65) Prior Publication Data

US 2012/0170285 A1 Jul. 5, 2012

(51) Int. Cl.
*H01R 13/625* (2006.01)

(52) U.S. Cl.
USPC ..... 439/333

(58) Field of Classification Search ..... 439/333, 439/337, 232, 334, 336, 671–673
See application file for complete search history.

(56) References Cited

U.S. PATENT DOCUMENTS

| | | | | |
|---|---|---|---|---|
| 4,872,097 | A | 10/1989 | Miller | |
| 5,422,487 | A | 6/1995 | Sauska et al. | |
| 7,448,911 | B2 | 11/2008 | Yang | |
| 7,714,494 | B2 | 5/2010 | Foo | |
| 2007/0254512 | A1* | 11/2007 | Bin | 439/232 |
| 2009/0039799 | A1* | 2/2009 | Newman et al. | 315/291 |

* cited by examiner

*Primary Examiner* — Tulsidas C Patel
*Assistant Examiner* — Phuong Nguyen
(74) *Attorney, Agent, or Firm* — Jenkins, Wilson, Taylor & Hunt, P.A.

(57) ABSTRACT

Fixtures, apparatuses, and related methods are provided that provide for a non-Edison connection for receiving a lamp housing of a lighting device having a non-Edison connector. The fixture can include a fixture housing and a non-Edison socket securable to the fixture housing. The fixture can also include an engagement device for engaging a lamp housing of a lighting device that has a non-Edison connector upon insertion of the lamp housing into the fixture housing and engaging the non-Edison socket.

42 Claims, 6 Drawing Sheets

FIXTURES, APPARATUSES, AND RELATED METHODS FOR PROVIDING LOAD BEARING CONNECTIONS FOR LIGHTING DEVICES

TECHNICAL FIELD

The present subject matter relates to fixtures, apparatuses, and related methods for connecting lighting devices in lighting sockets. In particular, the present subject matter relates to fixtures, apparatuses, and related methods for creating a load bearing connection between high efficacy solid state lighting devices and the lighting sockets they engage.

BACKGROUND

The Edison light bulb, i.e. the incandescent bulb, and socket have been around for over 100 years virtually unchanged as a testament to Edison's design. It incorporates a glass envelope, or bulb, with a closed volume and a glass fuse enclosure extending therein. Connecting wires run in the glass fuse enclosure and extend outward into the closed volume of the glass envelope. A coiled tungsten filament runs between the connecting wires and is supported by the supporting wires. The filament in a light bulb is made of a long, incredibly thin length of tungsten metal. In a typical 60-watt bulb, the tungsten filament is over 6 feet long but only one-hundredth of an inch thick. The tungsten is arranged in a double coil in order to fit it all in a small space. That is, the filament is wound up to make one coil, and then this coil is wound to make a larger coil. In a 60-watt bulb, the coil is less than an inch long.

The glass envelope is filled with an inert gas or gases at a low pressure. A screw cap caps the glass envelope at its base to create the closed volume. The glass fuse enclosure and the connecting wires are secured to the screw cap with one connecting wire in contact with the electrical foot contact in the screw cap and the other connecting wire in contact with the side of the screw cap. The glass fuse enclosure and the screw cap can be filled with an insulating material to isolate the connecting wires from each other.

When the bulb is connected to a power supply, an electric current flows from one contact to the other, through the wires and the filament. Electric current in a solid conductor is the mass movement of free electrons from a negatively charged area to a positively charged area.

As the electrons zip along through the filament, they are constantly bumping into the atoms that make up the filament. The energy of each impact vibrates an atom. In other words, the current heats the atoms up. A thinner conductor heats up more easily than a thicker conductor because it is more resistant to the movement of electrons.

Bound electrons in the vibrating atoms may be boosted temporarily to a higher energy level. When they fall back to their normal levels, the electrons release the extra energy in the form of photons. Metal atoms release mostly infrared light photons, which are invisible to the human eye. But if they are heated to a high enough level—around 4,000 degrees Fahrenheit (2,200 degrees Celsius) in the case of a light bulb—they will emit a good amount of visible light.

While the incandescent light bulb is good at creating visible light as demonstrated by its longevity over the years, it is very inefficient as can be gleaned by the process described above in creating light and uses a large amount of energy relative to its visible light output. As resources used to create energy have become more scarce and concerns about environment impact by consumption of such resources have grown, society has begun to look for a satisfactory replacement for the incandescent light bulb that is more energy efficient but still provides the desired amount of visible light.

Standards have been developed to begin to require the use of high efficiency lighting also known as high efficacy lighting. For example, the State of California has enacted energy efficiency standards for residential and nonresidential buildings, known as Title 24-2005 (hereinafter refer to as "California Title 24"). California estimates its efficiency standards will save $43 billion by 2013. Stricter efficiency standards also help avoid rolling blackouts, reduce peak demand, and avoid the need to build new generating capacity. California Title 24 requires high efficacy lighting, occupancy sensors or dimmers in almost all spaces. In general, high-efficacy lighting is generally thought of as energy-efficient lighting fixtures. Fluorescent and compact fluorescent (CFL) fixtures with electronic ballasts, as well as certain high-intensity discharge (HID) lamps fall into this category. Also, lighting fixtures that employ light emitting diodes (hereinafter "LED") are also considered high efficacy. Fluorescent and CFL fixtures with magnetic ballasts, incandescent lights and fixtures with incandescent sockets (regardless of the bulb type installed) are not considered high efficacy. Under California Title 24, high-efficacy lighting is defined as:

15 watts or less: Minimum of 40 lumens/watt;

15 to 40 watts: Minimum of 50 lumens/watt; and

More than 40 watts: Minimum of 60 lumens/watt.

To ensure that only proper high efficacy lighting devices will be used in the high efficacy lighting systems, a new engagement arrangement for securing the high efficacy lighting devices in, for example, a high efficacy lighting ballast was developed that does not work with the traditional incandescent lamp/bulb engagement arrangement. The traditional incandescent lamp/bulb engagement arrangement is the screw cap and socket arrangement. The screw cap, which has helical threads on its sidewalls and a foot contact at its base, screws into the socket which has matching threaded sidewalls and an electrical contact.

The GU-24 socket and base system is designed to replace the Edison socket and base in energy efficient lighting fixtures. These bases differ from traditional screw-in sockets in that they offer a simpler twist-and-click method of installation or removal. GU-24 lighting devices have two pins in the base which connect to the socket with a twist-and-lock connection. The two pins of the GU-24 lighting devices are inserted into socket holes in the socket. Once inserted, the lighting devices can be rotated, or twisted, in a clockwise direction in a 1/8, a 1/4 or a 1/2 of a turn to lock the base of the lighting devices in place in the socket. Screw-in CFLs and incandescent bulbs cannot be used in GU-24 fixtures.

The ENERGY STAR® Program Requirements for Residential Lighting Fixtures, Version 4.0 require that residential lighting fixtures cannot use the standard Edison screw base, even if they do not have a built-in ballast. The same requirement is comprised in California Title 24. This requirement is designed to insure that fixtures that receive ENERGY STAR® qualification when using an energy-efficient self-ballasted CFL, or are qualified as energy-efficient under California Title 24, cannot be operated with an incandescent lamp.

Beginning August 2008, the ENERGY STAR® technical specification (v4.1) expanded to comprise lamps that work with GU-24 bases. The major benefit of this new interface is that any fixture with a GU-24 socket will work with any bulb having a GU-24 connection.

Thus, the GU-24 socket was designed to be compatible with these energy efficiency regulations. The GU-24 base has two dual-diameter pins; the smaller portion having a diameter of 3.4 mm (0.13 inches) while the larger portion has a diameter of 5 mm (0.2 inches). Lighting devices with a GU-24 base are designed to be connected directly to the power line, so they are functionally equivalent to screw-base lighting devices instead of normal pin-base CFLs.

Another advantage of the GU-24 standard is that the lamp and ballast are always housed in the same unit. While slightly more costly to produce, this is more than overcome by their increased convenience and simplicity of maintenance. The savings become even more pronounced where lighting requirements are greater and more stringent, such as in large commercial facilities.

While the GU-24 socket and base system provide a good sturdy for lighting devices that hang downward to extend upward in a direction axial with the force of gravity, this does not hold true for every orientation of a lighting device using such a system. For example, the GU-24 socket and base system provides a less sturdy connection when the lighting device is held at an angle. For instance, the use of the GU-24 socket and base system in track lighting can be dangerous due to the fact that the lighting devices can be adjusted to and often are in an angled position. Since the lighting device is only twisted in a partial turn, it can have the tendency to "untwist if held at the right angle. This could lead to an electrical disconnection of the lighting device or even the disengagement the lighting device from the socket. Such disengagement of the lighting device from the socket can easily lead to property damage and/or personal injury.

SUMMARY

Fixtures, apparatuses, and methods for connecting lighting devices in lighting sockets are disclosed herein. For example, the present subject matter can comprise fixtures, apparatuses, and methods for creating a load bearing connection between high efficacy solid state lighting devices and the lighting sockets that they engage. It is an object of the presently disclosed subject matter to provide a fixture that provides for a non-Edison connection for receiving a lamp housing of a lighting device having a non-Edison connector.

An object of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

DETAILED DESCRIPTION

Figure 1C:
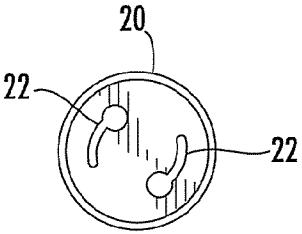
FIG. 1C illustrates a bottom plan view of an embodiment of a GU-24 socket used in the embodiment according to FIG. 1A.

Reference will now be made in detail to the description of the present subject matter, one or more examples of which are shown in the figures. Each example is provided to explain the subject matter and not as a limitation. In fact, features illustrated or described as part of one embodiment may be used in another embodiment to yield still a further embodiment. It is intended that the present subject matter cover such modifications and variations.

As illustrated in the various figures, some sizes of structures or portions are exaggerated relative to other structures or portions for illustrative purposes and, thus, are provided to illustrate the general structures of the present subject matter. Furthermore, various aspects of the present subject matter are described with reference to a structure or a portion being formed on other structures, portions, or both. As will be appreciated by those of skill in the art, references to a structure being formed "on" or "above" another structure or portion contemplates that additional structure, portion, or both may intervene. References to a structure or a portion being formed "on" another structure or portion without an intervening structure or portion can be described herein as being formed "directly on" the structure or portion.

Furthermore, relative terms such as "on" or "above" are used herein to describe one structure's or portion's relationship to another structure or portion as illustrated in the figures. It will be understood that relative terms such as "on" or "above" are intended to encompass different orientations of the device in addition to the orientation depicted in the figures. For example, if the device in the figures is turned over, structure or portion described as "above" other structures or portions would now be oriented "below" the other structures or portions. Likewise, if the device in the figures is rotated along an axis, structure or portion described as "above" other structures or portions would now be oriented "next to" or "left of" the other structures or portions. Like numbers refer to like elements throughout.

As used herein, "fixtures" refers to any structure or apparatus for receiving a lighting device that displays and powers the lighting device. For example, fixtures can comprise, but are not limited to, table lamps, standing lamps, wall lamps, handheld lamps, chandeliers, inset lighting, pendant lighting, or the like.

As used herein, "non-Edison connection" refers to a connection for an electrical lighting device and fixture that does not use a screw base and screw socket as used with screw-in Edison, or incandescent, light bulbs, or screw-in CFL's and related fixtures. Examples of non-Edison connections can comprise, but are not limited to, GU-24 lighting devices or other lighting devices that comprise two pins in a base which connect to a socket by a twist and lock connection by insertion of the two pins of the lighting devices into socket holes in the socket.

As used herein, "non-Edison connector(s)" refers to connector(s) on an electrical lighting device that do not use a screw base as used with screw-in Edison, or incandescent, light bulbs, or screw-in CFL's. Examples of non-Edison connectors can comprise, but are not limited to, pins on a GU-24 lighting device for engaging a socket or other lighting devices which connect to a socket by a twist and lock connection by insertion of the pins of a lighting device into socket holes in the socket.

As used herein, "non-Edison socket(s)" refers to socket(s) on a fixture that do not use a screw socket as used to engage screw-in Edison, or incandescent, light bulbs, or screw-in CFL's. Examples of non-Edison connections can comprise, but are not limited to, sockets for engaging GU-24 lighting devices or sockets for other lighting devices which connect to the socket by a twist and lock connection by insertion of the pins of the lighting devices into socket holes in the socket.

A fixture is provided that can provide for a non-Edison connection for receiving a lamp housing of a lighting device having a non-Edison connector. The fixture can comprise a fixture housing comprising side walls that form interior walls and a top wall. A non-Edison socket can be secured to the top wall of the housing. The interior walls can comprise an engagement device for engaging a lamp housing of a lighting device that comprises a non-Edison connection upon inserting the lamp housing into the fixture housing and engaging the non-Edison socket. The engagement device on the interior walls of the fixture housing can be a protrusion that is configured to engage a fastening receiver in the lamp housing. In some embodiments, the fastening receiver in the lamp housing can be a recess, a channel, or a groove. Alternatively or in addition to a recess, the fastening receiver in the lamp housing can comprise an aperture through the lamp housing. The engagement device of the fixture housing can prevent use of inappropriate lamp housings therein.

In some embodiments, the engagement device on the interior walls of the housing can further comprise a convex mound on which the protrusion resides. In such embodiments, the lamp housing can comprise a channel in which the fastening receiver in the lamp housing resides. The channel can be configured to receive the convex mound. The lamp housing can have an aperture therein, and the aperture can receive the protrusion on the mound as the lamp housing is slid into place.

In some embodiments, the engagement device in the form of a protrusion can be a pin. The pin can be spring loaded to engage a fastening receiver in the lamp housing. The fastening receiver can be sloped to help slide the pin into and out of locking placement.

In other embodiments, the engagement device on the interior walls of the housing can be a cross-sectional shape protruding portion of the interior walls that creates a frictional engagement with outer walls of the lamp housing. In such embodiments, the cross-sectional shape protruding portion can comprise an elliptical cross-sectional shape and the outer walls of the lamp housing can comprise a matching elliptical cross-sectional shape. In some of these embodiments, the cross-sectional shape can comprise a slight protuberance on at least one side. In such embodiments, a cross-sectional shape of the outer walls of the lamp housing can comprise a matching recess that is alignable upon insertion and twisting of the lamp housing into place in the fixture housing.

Figure 1B:
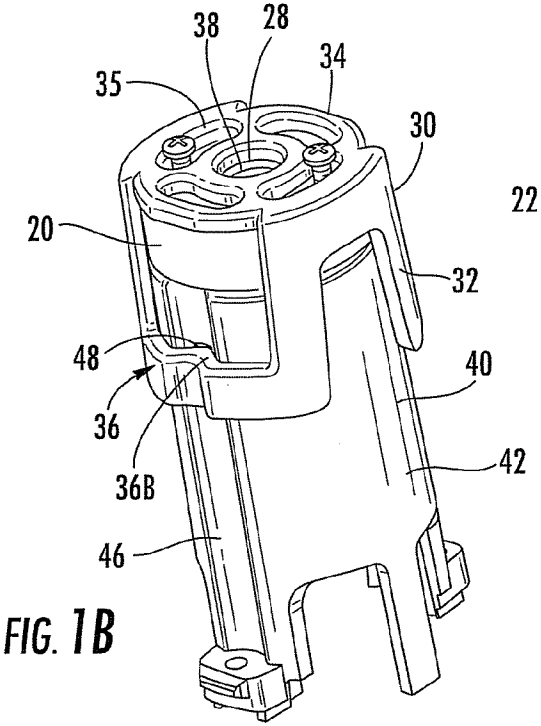
FIG. 1B illustrates a perspective view of a portion of the embodiments of the fixture and the lamp housing according to FIG. 1A.
Figure 1A:
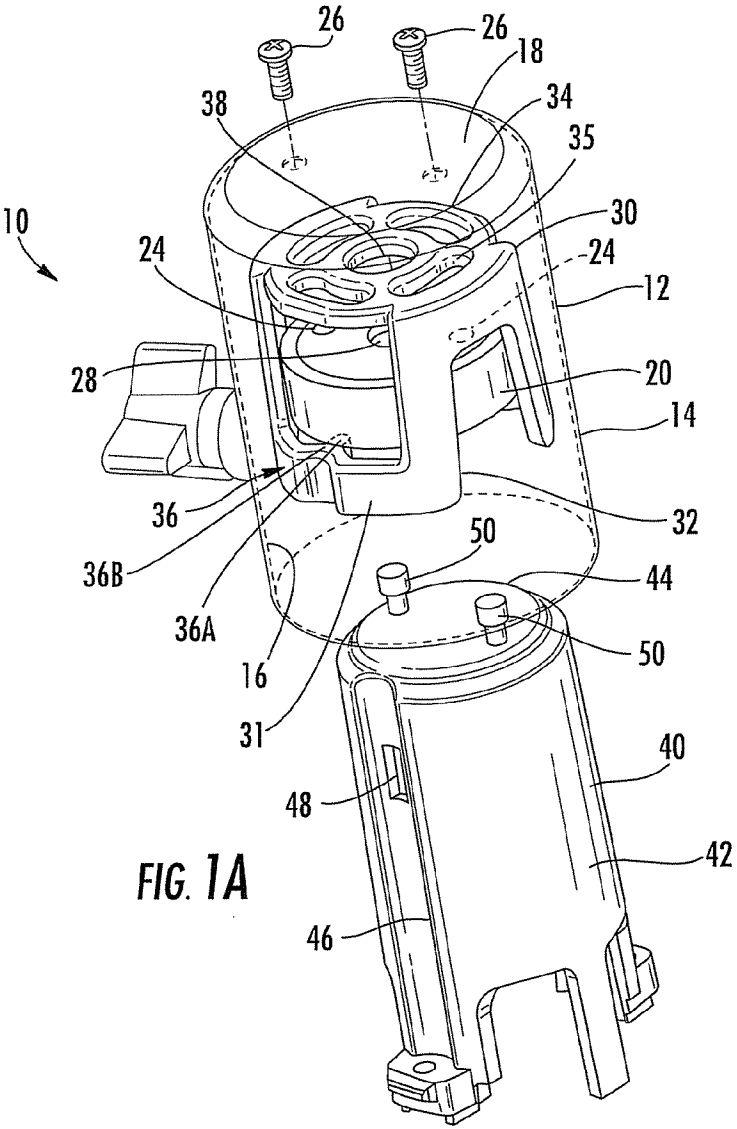
FIG. 1A illustrates an exploded perspective view of an embodiment of a portion of a fixture and an embodiment of a lamp housing according to the present subject matter.

FIGS. 1A, 1B, and 1C illustrate another embodiment of a fixture 10 that can provide for a non-Edison socket, such as a GU-24 connection, for receiving a lamp housing 40 of a lighting device having a non-Edison connector, such as a GU-24 connector. Fixture 10 can comprise a fixture housing 12 that can comprise one or more side walls 14 and interior walls 16. Fixture housing 12 can also comprise a top wall 18. Fixture 10 can also comprise a lamp lock 30 that is securable within fixture housing 12, lamp lock 30 comprising an engagement device 36 for engaging a lamp housing 40 of a lighting device that comprises a GU-24 connector 50. Further, fixture 10 can comprise a non-Edison socket, such as a GU-24 socket 20, securable with lamp lock 30 that engages GU-24 connectors 50 upon inserting lamp housing 40 into fixture housing 12. Engagement device 36 of lamp lock 30 can prevent the use of inappropriate lamp housings within fixture housing 12.

GU-24 socket 20 can comprise a face that has slots 22 therein for reception of GU-24 connectors 50 that extend outward from top wall 44 of lamp housing 40. GU-24 connectors 50 can be pins that comprise a head for insertion in the larger portion of slots 22 and a neck that fittingly slides within the slender portion of slots 22. GU-24 socket 20 can comprise a back that can comprise holes 24 that can be used to receive screws 26, or alternatively, rivets or pins, that can hold GU-24 socket 20 in fixture housing 12. GU-24 socket 20 can comprise also comprise an electrical engagement opening 28 for connecting GU-24 socket 20 to an electrical supply.

Lamp lock 30 can comprise arms 32 and a socket receiver in the form of a top wall 34. Arms 32 can connect engagement device 36 to top wall 34. For example, engagement device 36 can be on a base portion 31 that can extend between two arms 32. Top wall 34 can comprise slots 35 through which screws 26 can pass. Slots 35 can have a curved length that permits top wall 34 to slide or partially rotate around screws 26 between ends of slots 35. For example, curved length can be a size that permits lamp lock 30 to rotate as connectors 50 of the lamp and lamp housing 40 rotate within slots 22 of GU-24 socket 20. Top wall 34 of lamp lock 30 can also comprise an aperture 38 that aligns with electrical engagement opening 28 for connecting GU-24 socket 20 to an electrical supply.

As shown in FIGS. 1A, 1B, and 1C, engagement device 36 on lamp lock 30 can comprise a protrusion 36A that is configured to engage a fastening receiver 48 in lamp housing 40. Fastening receiver 48 in lamp housing 40 can be a recess in or an aperture through lamp housing 40. As shown, engagement device 36 can comprise a convex mound on which protrusion 36A resides. In such embodiments, lamp housing 40 further comprises a channel 46 in which fastening receiver 48 in lamp housing 40 resides. Channel 46 can be configured to receive the convex mound.

In some embodiments, protrusion 36A can be a pin. Such a pin can be spring-loaded to engage fastening receiver 48 of lamp housing 40. In other embodiments, protrusion 36A of engagement device 36 can comprise a cross-sectional shape that creates a frictional engagement with outer walls 42 of lamp housing 40. The cross-sectional shape of the protrusion can be an elliptical cross-sectional shape with the cross-sections narrowing as the protrusion reaches an end point. Outer walls 42 of lamp housing 40 can be an inversely matching elliptical cross-sectional shaped recess.

Arms 32 can act as cantilevers and bend outward to allow engagement device 36 to slip into fastening receiver of lamp housing 40. For example, base portions 31 can slide over top wall 34 and outer walls 42 as arms 32 bend outwards until convex mound 36B and protrusion 36A of engagement device 36 are aligned with and enter channel 46 and fastening receiver 48. Upon the acceptance of convex mound 36B and protrusion 36A of engagement device 36 in channel 46 and fastening receiver 48, respectively, arms 32 can resiliently resume their resting position. Lamp lock 30 or arms 32 of lamp lock 30 can be made of a material that is resilient enough to recover after bending and strong enough not to bend arms 32 outward under the weight of lamp that is inserted into lamp lock 30.

Figure 2C:
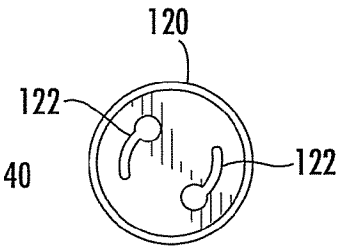
FIG. 2C illustrates a bottom plan view of an embodiment of a GU-24 socket used in the embodiment according to FIG. 2A.
Figure 2B:
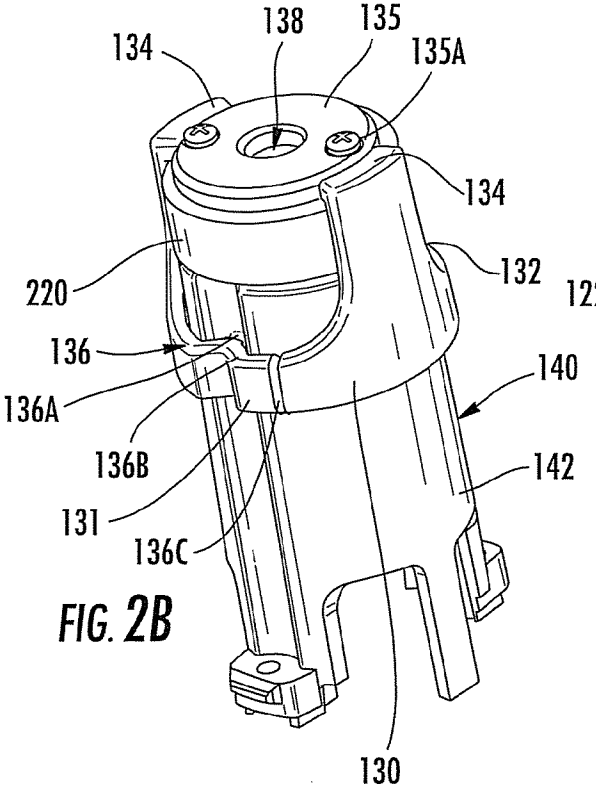
FIG. 2B illustrates a perspective view of a portion of the embodiments of the fixture and the lamp housing according to FIG. 2A.
Figure 2A:
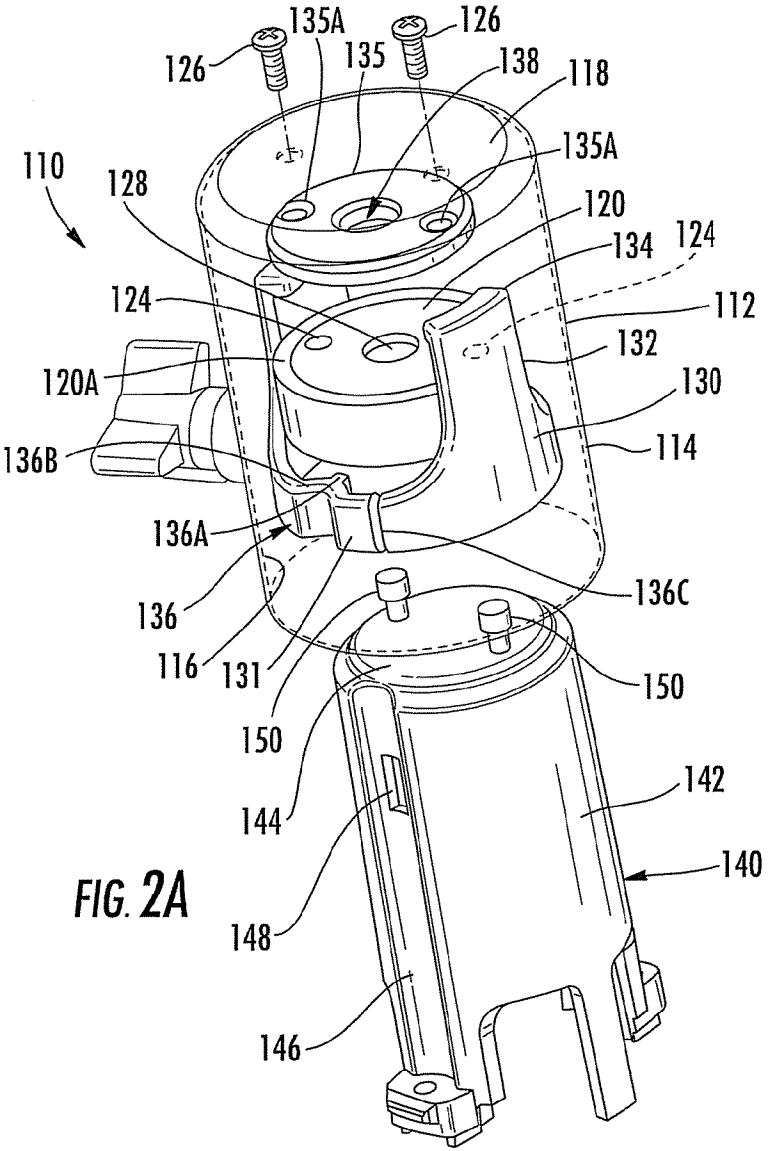
FIG. 2A illustrates an exploded perspective view of an embodiment of a portion of a fixture and an embodiment of lamp housing according to the present subject matter.

FIGS. 2A, 2B, and 2C illustrate a further embodiment of a fixture 110 that can be compatible with a GU-24 connection for receiving a lamp housing 140 of a lighting device having a GU-24 connector. Fixture 110 can comprise a fixture housing 112 that can comprise one or more side walls 114 that can form interior walls 116. Fixture housing 112 can also comprise a top wall 118. Fixture 110 can also comprise a lamp lock 130 that is securable within fixture housing 112 with lamp lock 130 comprising an engagement device 136 for engaging a lamp housing 140 of a lighting device that comprises GU-24 connectors 150. Further, fixture 110 can comprise a GU-24 socket 120 securable with lamp lock 130 that engages GU-24 connectors 150 upon inserting lamp housing 140 into fixture housing 112. Engagement device 136 of lamp lock 130 can prevent the use of inappropriate lamp housings within fixture housing 112 and can help hold lamp housing in place so that connectors 150 stay within socket 140.

As with the embodiment described above, GU-24 socket 120 can comprise a face that has slots 122 therein for reception of GU-24 connectors 150 that extend outward from top wall 144 of lamp housing 140. GU-24 connectors 150 can be pins that comprise a head for insertion in the larger portion of slots 122 and a neck that fittingly slides within the slender portion of slots 122. GU-24 socket 120 can comprise a back that can comprise holes 124 that can be used to receive screws 126, or alternatively, rivets or pins, that can hold GU-24 socket 120 in fixture housing 112. The back of GU-24 socket 120 can also comprise a shelf 120A. GU-24 socket 120 can also comprise an electrical engagement opening 128 for connecting GU-24 socket 120 to an electrical supply.

Lamp lock 130 can comprise arms 132. Lamp lock 130 can comprise at a top of each arm 132 a socket receiver in form of a ledge 134. Lamp lock 130 can also comprise a base portion 131 on which engagement device 136 can reside. Arms 132 can connect base portion 131 and engagement device 136 to top ledges 134. When lamp lock 130 is placed over socket 120, each top ledge 134 can extend over a portion of the back of GU-24 socket 120. For example, top ledge 134 can sit on shelf 120A of GU-24 socket 120 when lamp lock 130 is placed between top wall 118 of fixture housing 112 and GU-24 socket 120. A spacer 135 can be provided to be placed between top wall 118 of fixture housing 112 and back of GU-24 socket 120. Top ledges 134 are not hindered by spacer 135, fixture housing 112, or GU-24 socket 120 and can rotate with lamp lock 130 around GU-24 socket 120. For example, spacer 135 can have a greater width than the width of ledges 134. Thus, when spacer 135 is tightened against and between top wall 118 of fixture housing 112 and socket 120, there is a clearance between ledges 134 and top wall 118. Thereby, lamp lock 130 can more freely rotate around GU-24 socket 120. The rotation ability of lamp lock 130 permits lamp lock 130 to rotate with lamp housing 140 as the lighting device is rotated to engage GU-24 connectors 150 in GU-24 socket 120.

Spacer 135 can comprise holes 135A through which screws 126 can pass. Screws 126 can pass through holes 135A in spacer 135 and engage holes 124 in GU-24 socket 120. Spacer 135 of lamp lock 130 can also comprise an aperture 138 that aligns with electrical engagement opening 128 for connecting GU-24 socket 120 to an electrical supply.

As in the embodiments shown in FIGS. 1A, 1B, and 1C, engagement device 136 on lamp lock 130 of FIGS. 2A, 2B, and 2C can comprise one or more protrusions 136A that can be configured to engage corresponding fastening receivers 148 in lamp housing 140. Fastening receiver 148 in lamp housing 140 can be a recess in or an aperture through lamp housing 140. As shown, engagement device 136 can comprise a convex mound 136B on which protrusion 136A resides. In such embodiments, lamp housing 140 further comprises a channel 146 in which fastening receiver 148 in lamp housing 140 resides. Channel 146 can be configured to receive convex mound 136B. Engagement device 136 can comprise a slit 136C near protrusion 136A. Slit 136C can allow base portion 131 to act as a cantilever to permit reception and release of lamp lock 130 from lamp housing 140. In particular, slit 136C allows engagement device 136, and more particularly protrusion 136A, to deflect into and out of fastening receiver 148 in lamp housing 140 more easily.

Figure 2D:
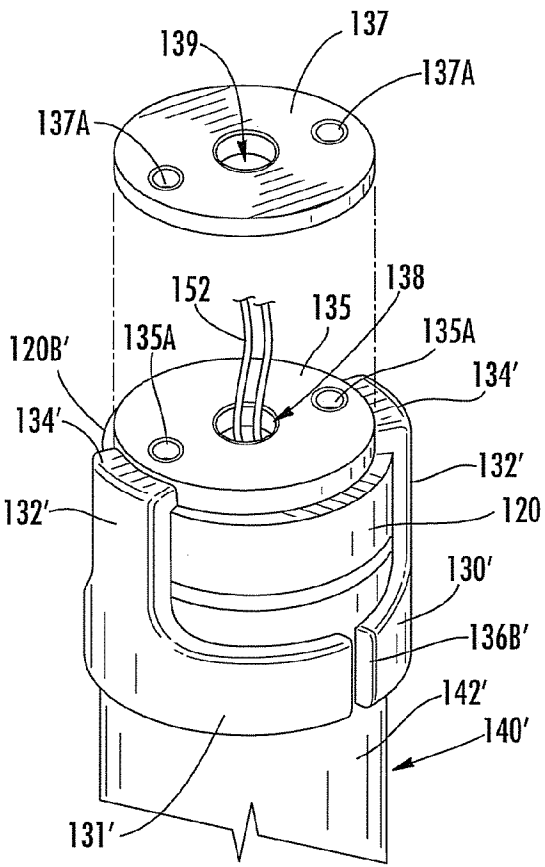
FIG. 2D illustrates a perspective view of the portion of the embodiments of the fixture and the lamp housing with an additional spacer according to FIG. 2A.

As shown in FIG. 2D, slightly different embodiments of a lamp housing 140' and a lamp lock 130' are provided. Lamp lock 130' has a base portion 131' that fits around outer walls 142' of lamp housing 140'. In FIG. 2D, a side of a base portion 131' of lamp lock 130' that has a slit 136B' is shown. Lamp lock 130' has an engagement device (not shown) on a side of lamp lock 130' that is opposite slit 136B' between arms 132' of lamp lock 130'. Slit 136B' permits base portion 131' to stretch to fit around lamp housing 140' until the engagement device is located in a fastening receiver (not shown) of lamp housing 140'. Outer walls 142' of lamp housing 140' may or may not have a channel to aid in guiding the engagement device to the fastening receiver. In such an embodiment, lamp lock 130' can be made from a material that is resilient and has good recoverability. Thus, upon stretching base portion 131' of lamp lock 130' until the engagement device finds the fastening receiver, base portion 131' resumes its natural state due to the resiliency of the material from which lamp lock 130' is constructed.

Arms 132' can extend from base portion 131' of lamp lock 130'. Each arm 132' can comprise a socket receiver in the form of a top ledge 134'. Each top ledge 134' can extend inward, so that when lamp lock 130' is placed around a GU-24 socket 120 each top ledge 134' extends over a portion of a back of GU-24 socket 120. For example, top ledge 134' can sit on an outer periphery 120B of GU-24 socket 120 when lamp lock 130' is placed between a top wall of a fixture (not shown) housing and GU-24 socket 120. One or more spacers 135, 137 can be provided to be placed between the top wall of the fixture housing and the back of GU-24 socket 120. Spacers 135, 137 can also comprise apertures 138, 139 that align with an electrical engagement opening (not shown) for connecting GU-24 socket 120 to an electrical supply. For example, an electrical connection 152 can extend from GU-24 socket 120 through apertures 138, 139 of spacers 135, 137. Spacers 135, 137 can also comprise fastening holes 135A, 137A for securing GU-24 socket 120 and spacers 135, 137 to a fixture.

Top ledge 134' can be configured to not be hindered by spacers 135, 137, fixture housing (not shown), or GU-24 socket 120. Extra spacer 137 can provide extra clearance between the top wall of a fixture (not shown) and top ledges 134' when spacers 135, 137 are tightened against and between socket 120 and a top wall of the fixture housing. Thereby, lamp lock 130' can more freely rotate around GU-24 socket 120. The rotation ability of lamp lock 130' permits lamp lock 130' to rotate with lamp housing 140' as the lighting device is rotated to engage GU-24 connectors (not shown) in GU-24 socket 120.

Figure 3B:
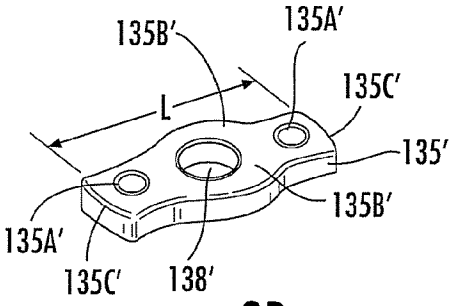
FIG. 3B illustrates a perspective view of an embodiment of a spacer used in the embodiments of the fixture and the lamp housing according to FIG. 3A.
Figure 3A:
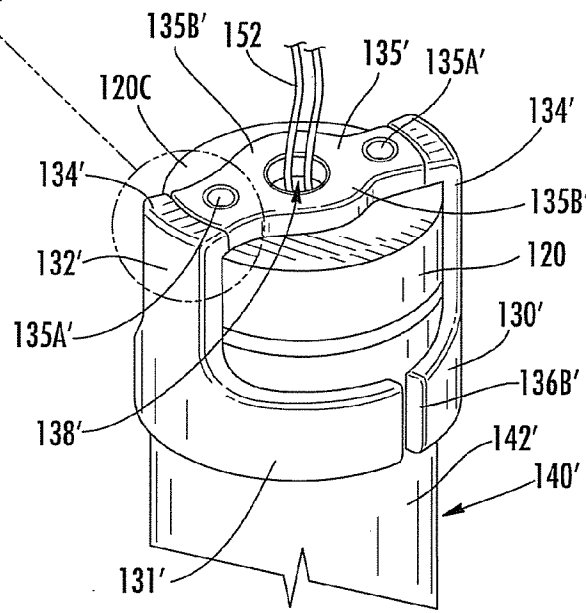
FIG. 3A illustrates a perspective view of an embodiment of a portion of a fixture and an embodiment of lamp housing according to the present subject matter.
Figure 3C:
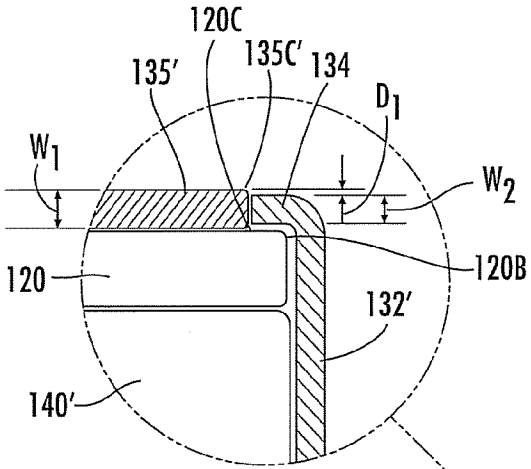
FIG. 3C illustrates a perspective view of a portion of the embodiments of the fixture and the lamp housing according to FIG. 3A.
Figure 4A:
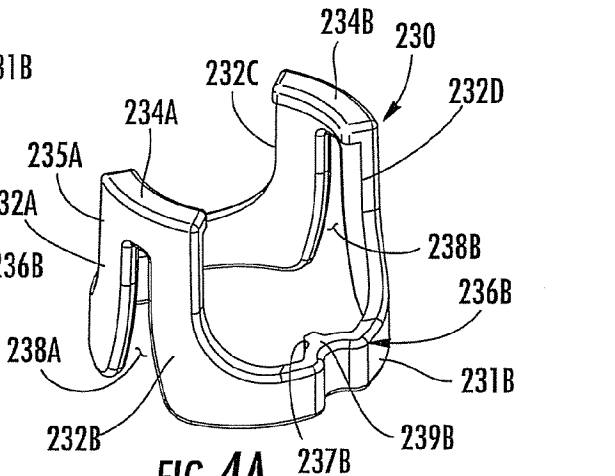
FIGS. 4A and 4B illustrate perspective views of an embodiment of a lamp lock according to the present subject matter.
Figure 4B:
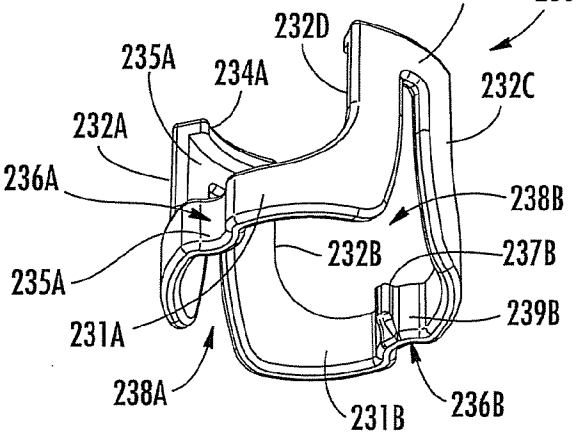
Figure 4E:
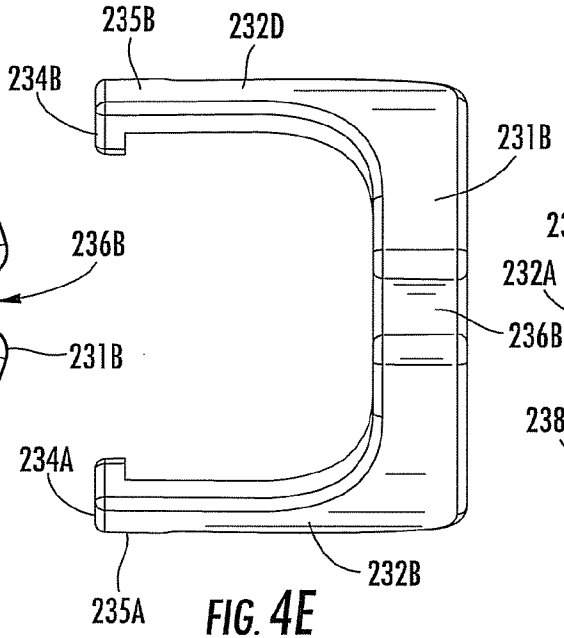
FIGS. 4D and 4E illustrate a side views of the embodiment the lamp lock according to FIGS. 4A and 4B.
Figure 4C:
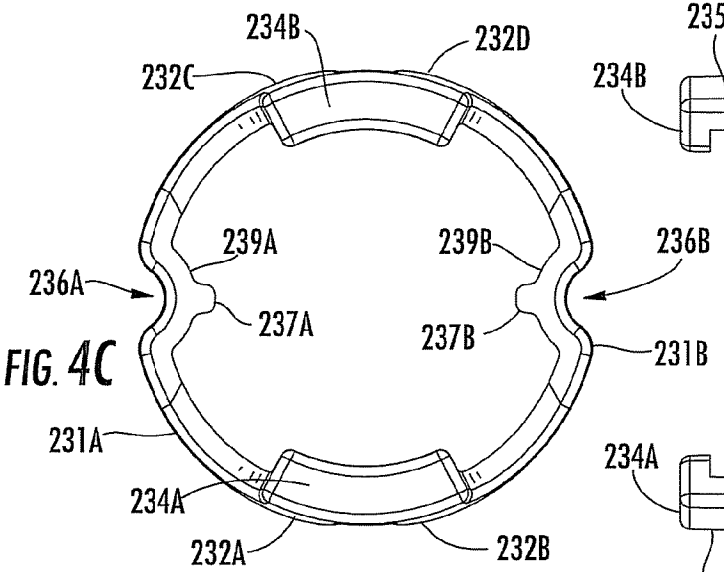
FIG. 4C illustrates a top view of the embodiment the lamp lock according to FIGS. 4A and 4B.
Figure 4D:
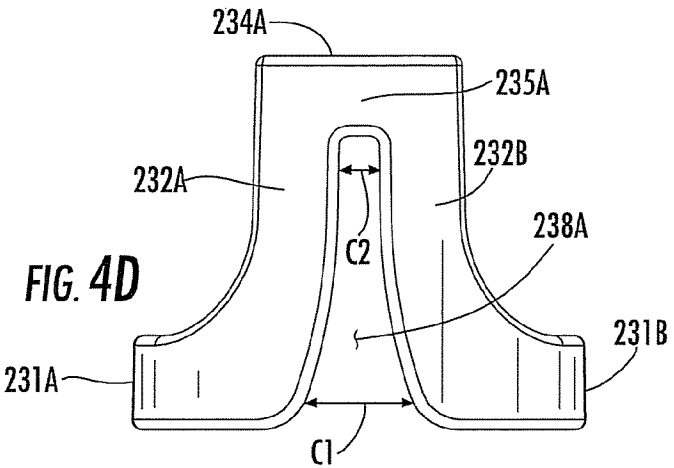

FIGS. 3A-3C illustrate a lamp lock 130' and lamp housing 140' similar to those provided in FIG. 2D. Therefore, the same reference numbers are generally used. As above, lamp lock 130' has a base portion 131' that fits around outer walls 142' of lamp housing 140'. Base portion 131' of lamp lock 130' can have a slit 136B'. Lamp lock 130' can have an engagement device (not shown) on a side of lamp lock 130' that is opposite slit 136B' between arms 132' of lamp lock 130'. Slit 136B' permits base portion 131' to stretch to fit around lamp housing 140' until the engagement device is located in a fastening receiver (not shown) of lamp housing 140'. Each top ledge 134' can extend inward, so that, when lamp lock 130' is placed around a GU-24 socket 120, each top ledge 134' extends over a portion of a back of GU-24 socket 120.

In the embodiment shown in FIGS. 3A-3C, a spacer 135' is provided that has a different shape. Instead of a circular disk shape, the size of spacer 135' is reduced on the sides that do not have fastening holes 135A' for engaging GU-24 socket 120. Spacer 135' can have an sides 135B' that are a width that accommodate an aperture 138' that can be aligned with an electrical engagement opening (not shown) for connecting GU-24 socket 120 to an electrical supply and fastening holes 135A for securing GU-24 socket 120 and spacer 135 to a fixture. Since aperture 138' through which an electrical connection 152 can extend from GU-24 socket 120 is larger in diameter (or cross-sectional shape) than fastening holes 138', spacer 135' can be enlarged at that portion to ensure structural integrity. End portions 135C' where fastening holes 135A' reside can thus be smaller and still maintain structural integrity, since fastening holes 135A' are smaller in diameter (or cross-sectional shape). Spacer 135' can have a length L. Length L of spacer 135' can be such that it provides space on a back 120C of GU-24 socket 120 for ledges 134' when ledges 134' are aligned with ends 135C' of spacer 135'. In this manner, ledge 134' can hold lamp lock 130' and any lamp housing 140' secured therein in a position proximal to GU-24 socket 120.

As shown in FIG. 3C, ledge 134' of arm 132 extends over outer edge 120B of GU-24 socket 120. Spacer 135', which is placed on back 120C of GU-24 socket 120 and can be secured thereto when GU-24 socket 120 is secured to a fixture, can have a width $W_1$ that is greater than width $W_2$ of ledge 134'. For example, width $W_1$ of spacer 135' can be greater in size than width $W_2$ of ledge 134' by a distance $D_1$. Distance $D_1$ can be, for example, about 0.5 mm. Such a distance can provide clearance between the top wall of a fixture (not shown) and top ledges 134' when spacer 135' is tightened against top wall of the fixture (not shown). Thereby, with the clearance between ends 135C' of spacer 135' and ledges 134' and the clearance provided by distance $D_1$ between ledge 134' shown in FIG. 3C and the top wall of the fixture (not shown), lamp lock 130 can rotate around GU-24 socket 120. The ability to rotate lamp lock 130' permits lamp lock 130' to rotate with lamp housing 140' as the lighting device is rotated to engage GU-24 connectors (not shown) on lamp housing 140' in GU-24 socket 120.

FIGS. 4A-4E illustrate a further embodiment of a lamp lock 230. Lamp lock 230 can comprise base portions 231A, 231B that can fit around a lamp housing (not shown). Lamp lock 230 comprises engagement devices 236A, 236B for engaging a lamp housing of a lighting device that comprises GU-24 connectors (not shown). Engagement devices 236A, 236B can reside on or be integral to base portion 231A, 231B, respectively. Lamp lock 230 can also comprise arms 232A, 232B, 232C, 232D, and socket receivers in the form of ledges 234A, 234B. In the embodiment shown, a pair of arms 232A, 232B is positioned across from another pair of arms 232C, 232D on the opposite side of lamp lock 230. Arms 232A, 232B can connect at an upper portion 235A on which ledge 234A resides and arms 232C, 232D can connect at an upper portion 235B on which ledge 234B. Arms 232A, 232C can connect to opposite ends of base portion 231A and arms 232B, 232D can connect to opposite ends of base portion 231B. In this manner, arms 232A, 232B and upper portion 235A form a channel 238A between arms 232A, 232B and arms 232C, 232D and upper portion 235B form a channel 238B between arms 232C, 232D. Channels 238A, 238B can narrow from a wider channel portion $C_1$ to a narrower channel portion $C_2$.

By being connected to an upper portion 235A, 235B and to a side of a base portion 231A, 231B, each arm 232A, 232B, 232C, 232D acts as a cantilever to allow base portions 231A, 231B to bend outward to accept the lamp housing between base portions 231A, 231B so that the engagement device(s) can engage and hold the lamp housing. Arms 232A, 232B, 232C, 232D can connect base portions 231A, 231B and engagement devices 236A, 236B to upper portion 235A, 235B and ledges 234A, 234B.

Engagement devices 236A, 236B on lamp lock 230 can each comprise a protrusion 237A, 237B that is configured to engage fastening receivers of the lamp housing (not shown), such as a recess or aperture. As shown, each engagement device 236A, 236B can comprise a convex mound 239A, 239B on which the respective protrusion 237A, 237B resides. In such embodiments, the lamp housing (not shown) can have channels in which the respective recesses or apertures in the lamp housing reside. The channels can be configured to receive convex mound 239A, 239B to help align the respective protrusions 237A, 237B with recesses or apertures in the respective channels.

Protrusions 237A, 237B can be rigid or deformable extensions from mounds 239A, 239B. Protrusion 236A of engagement device 236 can comprise a cross-sectional shape that creates a frictional engagement with outer walls of lamp housing. Alternatively, protrusions 237A, 237B can be pins. For example, protrusions 237A, 237B can be pins that are spring-loaded to engage the respective fastening receivers in the lamp housing.

Figure 5B:
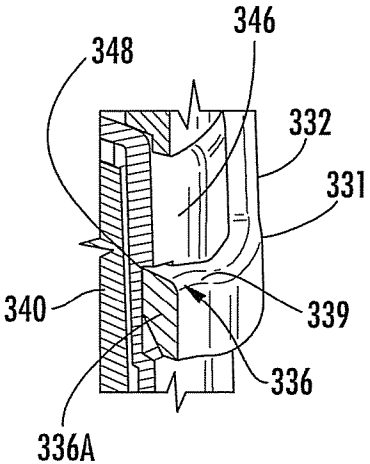
FIG. 5B illustrates a perspective view of a portion of the embodiments of the lamp lock and the lamp housing according to FIG. 5A.
Figure 5A:
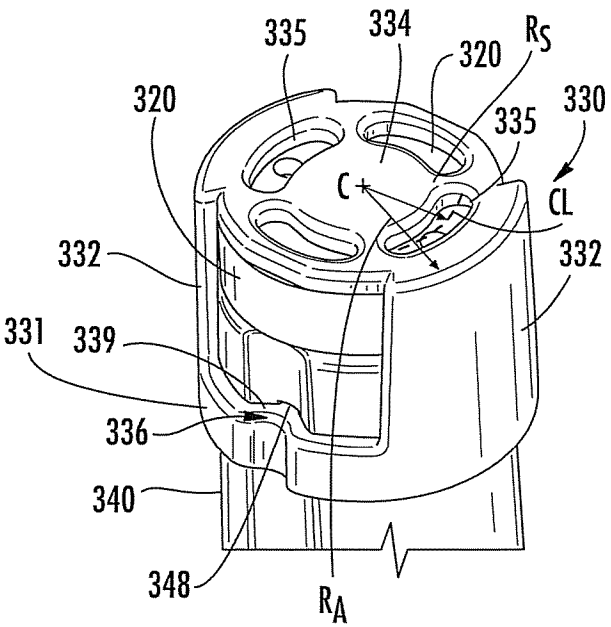
FIG. 5A illustrates a perspective view of an embodiment of a lamp housing and an embodiment of a lamp lock of a fixture according to the present subject matter.

FIGS. 5A-8B illustrate further embodiments of lamp locks and lamp housings that can be used in fixtures. In FIG. 5A, a lamp lock generally designated 330 and lamp housing 340 similar to those shown in FIGS. 1A and 1B are provided. Lamp lock 330 can comprise two wide arms 332 and a socket receiver in the form of a top wall 334. Top wall 334 as shown, can generally extend over a GU-24 socket 320 such that it covers the outer perimeter of socket 320. Each wide arm 332 can connect to a base portion 331 (of which only one is shown). An engagement device 336 can reside on one or more base portions 331. In some embodiments, an engagement device 336 can be on each base portion provided. Alternatively, one base portion 331 can comprise an engagement device 336 and another base portion can comprise a stretching slit (not shown) to allow lamp lock 330 to stretch outwardly at base portions 331 for acceptance of lamp housing 340. Wide arms 332 can connect base portions 331 to top wall 334.

Top wall 334 can comprise slots 335 through which screws (not shown) can pass to hold GU-24 socket 320 and lamp lock 330 to a fixture (not shown). Slots 335 can have a curved length with a radius of curvature $R_S$ as measured from a center point C of top wall 334 to a center line CL along slot 335. Wide arms 332 can have a curved length as well with a radius $R_A$ as measured from center point C of top wall 334. Radius of curvature $R_A$ of wide arms 332 is greater than radius of curvature $R_S$. Further, the curved length of wide arms 332 can be greater than the curved length of slots 335 so that wide arms 332 extend beyond the ends of slot 335 on either side. Such a construction can provide more strength to lamp lock 330. The curved length of slots 335 can permit top wall 334 to slide and rotate around the screws between the ends of slots 335 to allow for the rotation of the GU-24 connectors that are on the lamp housing within the slots of socket 320.

As shown in FIGS. 5A and 5B, engagement device 336 on lamp lock 330 can comprise a protrusion 336A that can be configured to engage a fastening receiver 348, which in the embodiment shown is a recess, in lamp housing 340. Engagement device 336 can comprise a convex mound on which protrusion 336A resides. As above, lamp housing 340 can further comprise a channel 346 in which fastening receiver 348 in lamp housing 340 resides. Channel 346 can be configured to receive the convex mound. In some similar embodiments, such channels in the lamp housings and convex mounds on the engagement devices may not be present. As shown in FIG. 5A, when lamp housing 340 and lamp lock 330 are in a locked position, convex mound 339 resides in channel 346 and protrusion 336A resides in fastening receiver 348.

Figure 6:
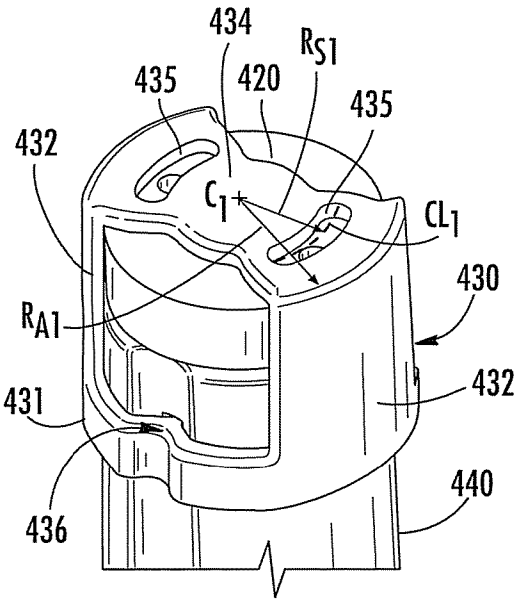
FIG. 6 illustrates a perspective view of another embodiment of a lamp housing and an embodiment of a lamp lock of a fixture according to the present subject matter.

In FIG. 6, a lamp lock 430 and lamp housing 440 similar to those shown in FIGS. 5A and 5B are provided. Lamp lock 430 can comprise two wide arms 432 and a socket receiver in the form of a top wall 434. Each wide arm 432 can connect to a base portion 431 (of which only one is shown). An engagement device 436 can reside on each base portion 431. In such embodiments, a slit can be provided in each base portion 431. Alternatively, one engagement device 436 can reside on one base portion 431, and a slit can be formed in another base portion 431, for example, a base portion (not shown) on an opposite side of lamp lock 330 from base portion 431 on which engagement device 436 resides. Wide arms 432 can connect base portions 431 and engagement device 436 to top wall 434. Top wall 434 can comprise slots 435 through which screws (not shown) can pass to hold a GU-24 socket 420 and lamp lock 430 to a fixture (not shown).

As with the embodiment shown in FIG. 5A, slots 435 in top wall 434 of lamp lock 430 in FIG. 6 can have a curved length with a radius of curvature $R_{S1}$ as measured from a center point $C_1$ of top wall 434 to a center line $CL_1$ along slot 435. Wide arms 432 can have a curved length as well that has a radius $R_{A1}$ as measured from center point $C_1$ of top wall 434. Radius of curvature $R_{A1}$ of wide arms 432 can be greater than radius of curvature $R_{S1}$. Further, the curved length of wide arms 432 can be greater than the curved length of slots 435 so that wide arms 432 extend beyond the ends of slot 435 on either side. Such a construction can provide more strength to lamp lock 430. The curved length of slots 435 can permit top wall 434 to slide and rotate around the screws between the ends of slots 435 to allow for the rotation of the GU-24 connectors that are on the lamp housing within the slots of socket 420.

Figure 7B:
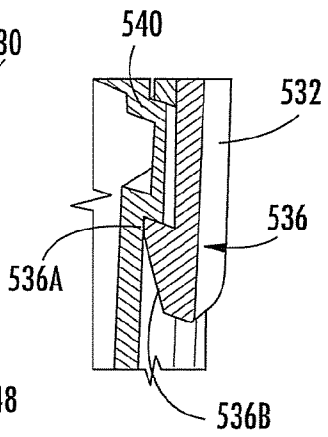
FIG. 7B illustrates a perspective view of a portion of the embodiments of the lamp lock and the lamp housing according to FIG. 7A.
Figure 7A:
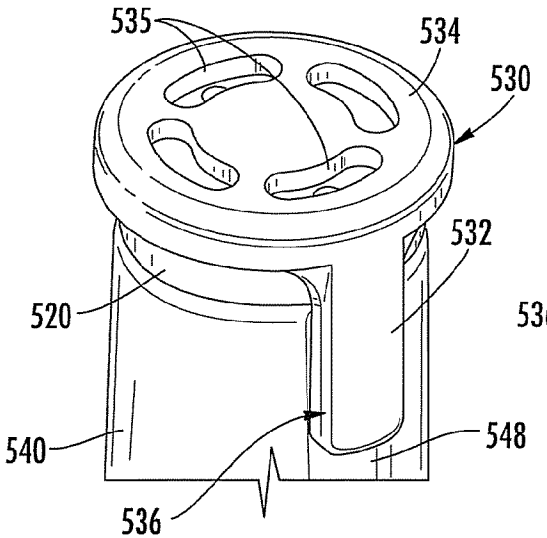
FIG. 7A illustrates a perspective view of another embodiment of a lamp housing and an embodiment of a lamp lock of a fixture according to the present subject matter.

In FIGS. 7A and 7B, other embodiments of a lamp lock 530 and lamp housing 540 are provided. Lamp lock 530 can comprise one or more arms 532 and a top wall 534. Top wall 334, as shown, can generally extend over a GU-24 socket 520. For example, top wall 334 can extend over an outer perimeter of socket 520. In some embodiments, top wall 334 can extend around an outer perimeter of socket 520. An engagement device 536 can reside on each arm 532. Top wall 534 can comprise slots 535 through which fastening devices, such as screws (not shown), can pass to hold GU-24 socket 520 and lamp lock 530 to a fixture (not shown). Slots 535 can have a curved length that permits top wall 534 to rotatably slide around the screws between the ends of slots 535. The curved length can be of such a size that it permits lamp lock 530 to rotate as the connectors (not shown) of the lamp and lamp housing 540 rotate within slots (not shown) of GU-24 socket 520. An aperture can be present in the center of top wall 534 through which an electrical connection (not shown) to GU-24 socket 520 can pass.

As shown in FIGS. 7A and 7B, engagement device 536 on lamp lock 530 can comprise a protrusion 536A that can be configured to engage a fastening receiver 548 in lamp housing 540. When placing a lamp with a lamp housing 540 into the fixture that employs lamp lock 530, arms 532 can gradually flex outward as the top and sides of lamp housing 540 engagement a ramped surface 536B of protrusion 536A until the extended end of protrusion 536A enters recess 548. As shown in FIG. 7A, when lamp housing 540 and lamp lock 530 are in a locked position, protrusion 536A resides in recess 548 and arms 532 generally extend perpendicular to the outer circumference of top wall 334.

Figure 8B:
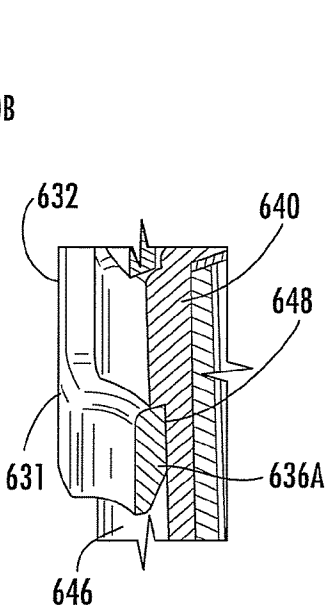
FIG. 8B illustrates a perspective view of a portion of the embodiments of the lamp lock and the lamp housing according to FIG. 8A.
Figure 8A:
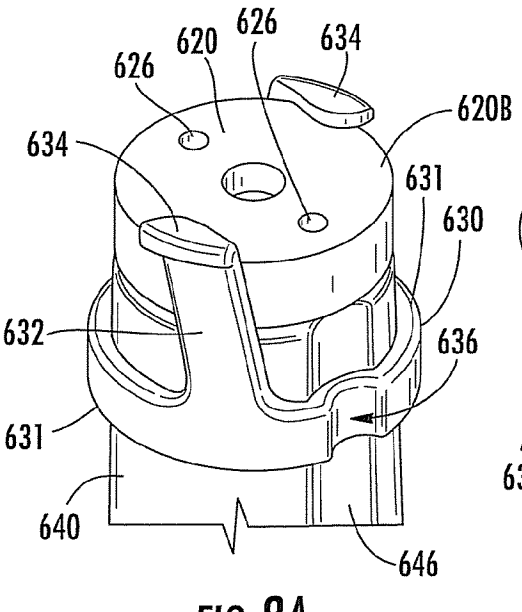
FIG. 8A illustrates a perspective view of a further embodiment of a lamp housing and an embodiment of a lamp lock of a fixture according to the present subject matter.

In FIG. 8A, a lamp lock 630 and lamp housing 640 are provided. Lamp lock 630 can comprise two slanted arms 632 and ledges 634. Each top ledge 634 can extend inward, so that when lamp lock 630 is placed around a GU-24 socket 620 each top ledge 634 extends over a portion of a back of GU-24 socket 620. For example, top ledge 634 can sit on an outer periphery 620B of GU-24 socket 620 that is outside of fastening locations 626 of socket 620 when lamp lock 630 is placed between a top wall of a fixture (not shown) housing and GU-24 socket 620. Each slanted arm 632 can connect to a base portion 631. An engagement device 636 can reside on each base portion 631. Slanted arms 632 can connect base portion 631 and engagement device 636 to top ledge 634.

As shown in FIGS. 8A and 8B, engagement device 636 on lamp lock 630 can comprise a protruding mound 636A that can be configured to engage a fastening receiver 648, which in the embodiment shown is a recess, in lamp housing 640. Protruding mound 636A of engagement device 636 can have a radius of curvature that matches a radius of curvature of recess 648. As above, lamp housing 640 can further comprise a channel 646 in which recess 648 in lamp housing 640 can reside. The recess can generally extend over the width of channel 646. Channel 646 can be configured to receive protruding mound 636A until it snaps into recess 648. In some similar embodiments, such channels may not be present. As shown in FIG. 8A, when lamp housing 640 and lamp lock 630 are in a locked position, protruding mound 636A can reside in channel 646.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A fixture comprising a non-Edison connection for a lighting device having a non-Edison connector, the fixture comprising:

a fixture housing;

a non-Edison socket securable to the fixture housing; and an engagement device securable to the fixture housing, the engagement device comprising a protrusion configured to engage a fastening receiver of a lamp housing of the lighting device upon insertion of the lamp housing into the fixture housing and engaging the non-Edison socket.

2. The fixture according to claim 1, wherein the fixture housing comprises a top wall and side walls that form interior walls, the engagement device being disposed on the interior walls of the fixture.

3. The fixture according to claim 1, wherein the engagement device comprises a protruding portion of interior walls of the fixture housing that creates a frictional engagement with outer walls of the lamp housing.

4. The fixture according to claim 1, wherein the engagement device of the fixture housing is configured to prevent use of inappropriate lamp housings therein.

5. The fixture according to claim 1, wherein the non-Edison connector and the non-Edison socket comprise a GU-24 connector and a GU-24 socket, respectively.

6. The fixture according to claim 1, further comprising a lamp lock on which the engagement device resides.

7. The fixture according to claim 6, wherein the lamp lock is securable within the fixture housing.

8. The fixture according to claim 1, wherein the fastening receiver in the lamp housing comprises a recess.

9. The fixture according to 8, wherein the fastening receiver in the lamp housing comprises an aperture through the lamp housing.

10. The fixture according to claim 8, wherein the engagement device further comprises a convex mound on which the protrusion resides, and the lamp housing further comprises a channel in which the fastening receiver in the lamp housing resides, the channel being configured to receive the convex mound.

11. The fixture according to claim 8, wherein the protrusion comprises a pin.

12. A fixture compatible with a GU-24 connection for receiving a lamp housing of a lighting device comprising a GU-24 connector, the fixture comprising:

a fixture housing;

a lamp lock that is securable to the fixture housing, the lamp lock comprising an engagement device for engaging a lamp housing of a lighting device, wherein the engagement device comprises a protrusion that is configured to engage a fastening receiver disposed in the lamp housing; and a GU-24 socket securable to the fixture housing and engagable with the GU-24 connector upon insertion of the lamp housing into the fixture housing.

13. The fixture according to claim 12, wherein the fastening receiver in the lamp housing comprises a recess.

14. The fixture according to claim 12, wherein the fastening receiver in the lamp housing comprises an aperture through the lamp housing.

15. The fixture according to claim 12, wherein the engagement device on the lamp lock further comprises a convex mound on which the protrusion resides and the lamp housing further comprises a channel in which the fastening receiver in the lamp housing resides, the channel being configured to receive the convex mound.

16. The fixture according to claim 12, wherein the engagement device of the lamp lock is configured to prevent use of inappropriate lamp housings within the fixture housing.

17. The fixture according to claim 12, wherein the lamp lock comprises one or more arms and a base portion.

18. The fixture according to claim 17, wherein the lamp lock comprises a top wall that is connected to the base portion by the one or more arms.

19. The fixture according to claim 18, wherein the top wall of the lamp lock has slots therein configured to permit the lamp lock to be secured to the fixture housing, the slots allowing the lamp lock to rotate with the lamp housing when the GU-24 connector of the lighting device engages the GU-24 socket.

20. The fixture according to claim 19, wherein the fixture housing comprises one or more side walls and a top wall, the top wall of the lamp lock, being securable between the top wall of the fixture housing and the GU-24 socket.

21. The fixture according to claim 17, wherein the lamp lock comprises one or more ledges extending from the one or more arms, the ledges configured for receiving the GU-24 socket.

22. The fixture according to claim 21, further comprising a spacer that is securable between the fixture housing and the GU-24 socket to provide clearance for the lamp lock to be rotatable around the GU-24 socket.

23. The fixture according to claim 21, wherein the lamp lock is rotatable around an outer periphery of the GU-24 socket.

24. A lamp lock for inclusion in a fixture for receiving a lamp housing of a lighting device having a non-Edison connector, the lamp lock comprising:

a socket receiver that engages a non-Edison socket;

an arm extending from the socket receiver below the non-Edison socket; and an engagement device for engaging a lamp housing of a lighting device, wherein the engagement device comprises a protrusion configured to engage a fastening receiver disposed in the lamp housing upon insertion of the lamp housing into a fixture housing and engaging the non-Edison socket.

25. The lamp lock according to claim 24, wherein the socket receiver comprises a top wall connected to the arm.

26. The lamp lock according to claim 24, wherein the engagement device on the lamp lock further comprises a convex mound on which the protrusion resides.

27. The lamp lock according to claim 24, wherein the protrusion comprises a pin.

28. The lamp lock according to claim 24, wherein the protrusion of the engagement device comprises a cross-sectional shape that creates a frictional engagement with outer walls of the lamp housing.

29. The lamp lock according to claim 24, further comprising a base portion secured to the arm and on which the engagement device resides.

30. The lamp lock according to claim 24, wherein the engagement device resides on the arm.

31. The lamp lock according to claim 24, wherein the socket receiver comprises one or more ledges extending from the one or more arms, the ledges for receiving the socket.

32. The lamp lock according to claim 31, wherein the lamp lock is rotatable around an outer periphery of the socket.

33. The lamp lock according to claim 24, further comprising a plurality of arms that extend from the socket receiver.

34. The lamp lock according to claim 33, wherein each arm of the plurality of arms has an engagement device thereon.

35. A lamp housing of a lighting device having a non-Edison connector, the lamp housing comprising:

a top wall from which a non-Edison connector extends; and an outer wall extending from the top wall, the outer wall comprising a fastening receiver for receiving an engagement device within a fixture housing to hold the lighting device in the fixture housing.

36. The lamp housing according to claim 35, wherein the fastening receiver in the lamp housing comprises a recess.

37. The lamp housing according to claim 35, wherein the fastening receiver in the lamp housing comprises an aperture through the lamp housing.

38. The lamp housing according to claim 35, further comprising a channel in which the fastening receiver in the lamp housing resides, the channel configured to receive a portion of the engagement device.

39. A method for assembling a fixture that provides for a non-Edison connection with a lighting device having a non-Edison connector, the method comprising:

providing a fixture housing;

providing a lamp lock comprising an engagement device for engaging a lamp housing of the lighting device that comprises a non-Edison connector, wherein the lamp housing comprises a fastening receiver for receiving the engagement device of the lamp lock;

providing a non-Edison socket engagable with the non-Edison connector; and securing the lamp lock and the non-Edison socket to the fixture housing so that the engagement device of the lamp lock is configured to hold the lamp housing in a position in which the non-Edison socket is engagable with the non-Edison connector of the lamp housing upon insertion of the lamp housing into the fixture housing.

40. The method according to claim 39, further comprising inserting the lamp lock into the fixture housing and inserting the GU-24 socket into the lamp lock and securing the fixture housing, lamp lock, and GU-24 socket together with a fastening device.

41. The method according to claim 39, further comprising providing a spacer securable between the fixture housing and the GU-24 socket to permit the lamp lock to be rotatable.

42. The method according to claim 39, further comprising inserting a lamp housing of a lighting device into the lamp lock such that the engagement device engages the lamp housing.

* * * * *